US010011778B2

(12) United States Patent
Luebke et al.

(10) Patent No.: US 10,011,778 B2
(45) Date of Patent: Jul. 3, 2018

(54) PROCESS AND APPARATUS FOR IMPROVING PROPYLENE YIELD FROM A FLUID CATALYTIC CRACKING PROCESS

(71) Applicant: UOP LLC, Des Plaines, IL (US)

(72) Inventors: Charles P. Luebke, Mount Prospect, IL (US); Kirk Liu, Chicago, IL (US); Zhihao Fei, Naperville, IL (US)

(73) Assignee: UOP LLC, Des Plaines, IL (US)

( * ) Notice: Subject to any disclaimer, the term of this patent is extended or adjusted under 35 U.S.C. 154(b) by 481 days.

(21) Appl. No.: 14/109,895

(22) Filed: Dec. 17, 2013

(65) Prior Publication Data

US 2015/0166433 A1 Jun. 18, 2015

(51) Int. Cl.

| | |
|---|---|
| ***C07C 4/02*** | (2006.01) |
| ***C07C 7/10*** | (2006.01) |
| ***C10G 11/18*** | (2006.01) |

(52) U.S. Cl.

CPC ..... *C10G 11/18* (2013.01); *C10G 2300/1077* (2013.01); *C10G 2400/20* (2013.01)

(58) Field of Classification Search

None

See application file for complete search history.

(56) References Cited

U.S. PATENT DOCUMENTS

| | | | | |
|---|---|---|---|---|
| 5,523,502 | A | 6/1996 | Rubin | |
| 6,586,649 | B1 | 7/2003 | Botha et al. | |
| 7,262,332 | B2 | 8/2007 | Duplan et al. | |
| 7,579,513 | B2 | 8/2009 | Duplan et al. | |
| 7,816,572 | B2 | 10/2010 | Leyshon et al. | |
| 2003/0171634 | A1* | 9/2003 | Corma | C10G 11/05 585/648 |
| 2005/0154246 | A1* | 7/2005 | Adrian | C07C 7/08 585/862 |
| 2007/0129586 | A1* | 6/2007 | Zimmermann | C10G 51/04 585/324 |
| 2008/0156696 | A1 | 7/2008 | Niccum et al. | |
| 2008/0200745 | A1 | 8/2008 | Sigl et al. | |
| 2010/0240937 | A1* | 9/2010 | Gartside | C07C 4/02 585/315 |
| 2010/0274066 | A1* | 10/2010 | Upson | B01J 29/80 585/653 |

(Continued)

FOREIGN PATENT DOCUMENTS

| | | | |
|---|---|---|---|
| CN | 86104676 | A | 3/1987 |
| WO | 2011056691 | A2 | 5/2011 |

OTHER PUBLICATIONS

Search Report dated Feb. 25, 2015 for corresponding PCT Appl. No. PCT/US2014/068279.

*Primary Examiner* — Philip Y Louie

(57) ABSTRACT

The present invention discloses a process optimizing the yield of propylene from a fluid catalytic cracking unit. The method combines a first catalytic reactor, a fractionation zone, a separation unit and a second catalytic reactor. The separation unit produces a first separation unit stream and a second separation unit stream, the first separation unit stream comprising $C_x$ paraffins, and the second separation unit stream comprising $C_x$ olefins, wherein the second separation unit stream is passed to a second catalytic reactor and the first separation unit stream is removed from the process.

16 Claims, 5 Drawing Sheets

(56) References Cited

U.S. PATENT DOCUMENTS

| | | | | |
|---|---|---|---|---|
| 2010/0331589 | A1* | 12/2010 | Zimmermann | C07C 5/05 585/314 |
| 2011/0245559 | A1* | 10/2011 | da Silva Ferreira Alves | C07C 7/14883 585/323 |
| 2012/0141333 | A1 | 6/2012 | Ulas Acikgoz et al. | |
| 2013/0261359 | A1 | 10/2013 | da Silva Ferreira Alves et al. | |

* cited by examiner

PROCESS AND APPARATUS FOR IMPROVING PROPYLENE YIELD FROM A FLUID CATALYTIC CRACKING PROCESS

BACKGROUND OF THE INVENTION

The disclosure relates to an extraction process for improving propylene yield.

Fluid catalytic cracking (FCC) is a catalytic hydrocarbon conversion process accomplished by contacting heavier hydrocarbons in a fluidized reaction zone with a catalytic particulate material. The reaction in catalytic cracking, as opposed to hydrocracking, is carried out in the absence of substantial added hydrogen or the consumption of hydrogen. Various products may be produced from such a process, including a naphtha product and/or a light product such as propylene and/or ethylene.

There have been several development efforts to increase the propylene yield from an FCC unit. One of the solutions has been to recycle the 4- and/or 5-carbon olefin product back to the FCC unit in order to selectively crack these components to propylene. Another solution is to recycle the olefins back to a second reactor optimized to convert the olefins to propylene. In this case, a separate recovery section is needed to process the product from the second reactor. This configuration works well at low to moderate propylene yields, but if higher yields are required, then the amount of material that needs to be recycled increases rapidly as the 4- and/or 5-carbon paraffins are not separated from the 4- and/or 5-carbon olefins in most FCC processes. As the paraffins cannot be rejected, this inert material must also be recycled in order to be able to recycle a greater amount of the olefin material.

Therefore, what is needed is a new process configuration which allows for the advantages of a traditional FCC unit configuration, but improves the overall configuration by allowing for the 4- and/or 5-carbon paraffins to be separated from the 4- and/or 5-carbon olefins. The overall FCC process recovery section is simplified compared to a process using the aforementioned second reactor as a common recovery section can be used.

SUMMARY OF THE INVENTION

An is a process for catalytic cracking, the process comprising (a) feeding a hydrocarbon feed stream to a first catalytic reactor; (b) passing an effluent of the first catalytic reactor to a fractionation zone to produce a first fractionation zone stream and a second fractionation zone stream, the first fractionation zone stream comprising $C_{(x-1)}^-$ hydrocarbons, and the second fractionation zone stream comprising $C_x$ hydrocarbons, wherein x is an integer; (c) passing the second fractionation zone stream to a separation unit to produce a first separation unit stream and a second separation unit stream, the first separation unit stream comprising $C_x$ paraffins, and the second separation unit stream comprising $C_x$ olefins; and (d) feeding the second separation unit stream to a second catalytic reactor. An embodiment further comprises (e) producing a third fractionation zone stream comprising $C_{(x+1)}^+$ hydrocarbons in the fractionation zone; and (f) feeding the third fractionation zone stream to the second catalytic reactor. An embodiment is a catalytic cracking system, comprising a first catalytic reactor configured to receive a hydrocarbon feed stream; a fractionation zone, the fractionation zone is in fluid communication with the first catalytic reactor, wherein the fractionation zone is configured to produce a first fractionation zone stream comprising $C_3$ hydrocarbons and a second fractionation zone stream comprising $C_4$ hydrocarbons; a separation unit, the separation unit is in fluid communication with fractionation zone, wherein separation unit is configured to produce a first separation unit stream comprising $C_4$ paraffins and a second separation unit stream comprising $C_4$ olefins; and a second catalytic reactor, the second catalytic reactor being in fluid communication with the separation unit for receiving the second separation unit stream.

These and other features, aspects, and advantages of the present invention will become better understood upon consideration of the following detailed description, drawings and appended claims.

BRIEF DESCRIPTION OF THE DRAWINGS

Like reference numerals will be used to refer to like parts from Figure to Figure in the following description of the drawings.

DETAILED DESCRIPTION OF THE INVENTION

As used herein, the following terms have the corresponding definitions.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "column" means a distillation column or columns for separating one or more components of different volatilities which may have a reboiler on its bottom and a condenser on its overhead. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the outlet of the column. The bottom temperature is the liquid bottom outlet temperature.

The term "$C_x$ hydrocarbons" wherein "x" is an integer means hydrocarbons having x carbon atoms.

The term "$C_x^-$" wherein "x" is an integer means a hydrocarbon stream with hydrocarbons having x and/or less carbon atoms and preferably x and less carbon atoms.

The term "$C_x^+$" wherein "x" is an integer means a hydrocarbon stream with hydrocarbons having x and/or more carbon atoms and preferably x and more carbon atoms.

The term "predominant" means a majority, suitably at least 80 wt % and preferably at least 90 wt %.

DESCRIPTION OF THE INVENTION

Figure 1:
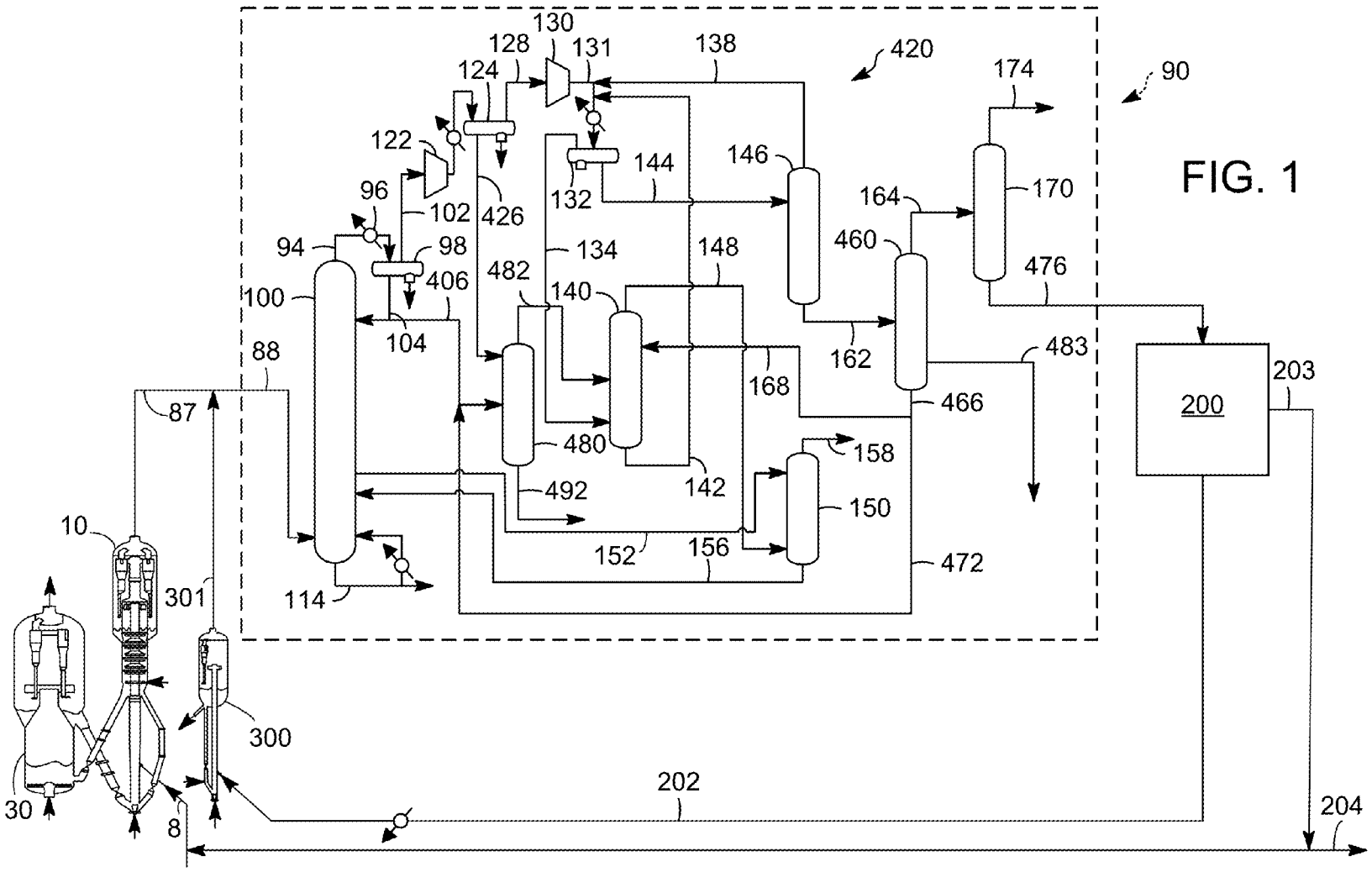
FIG. 1 is a process flow scheme for one embodiment of a process of the present invention.
Figure 2:
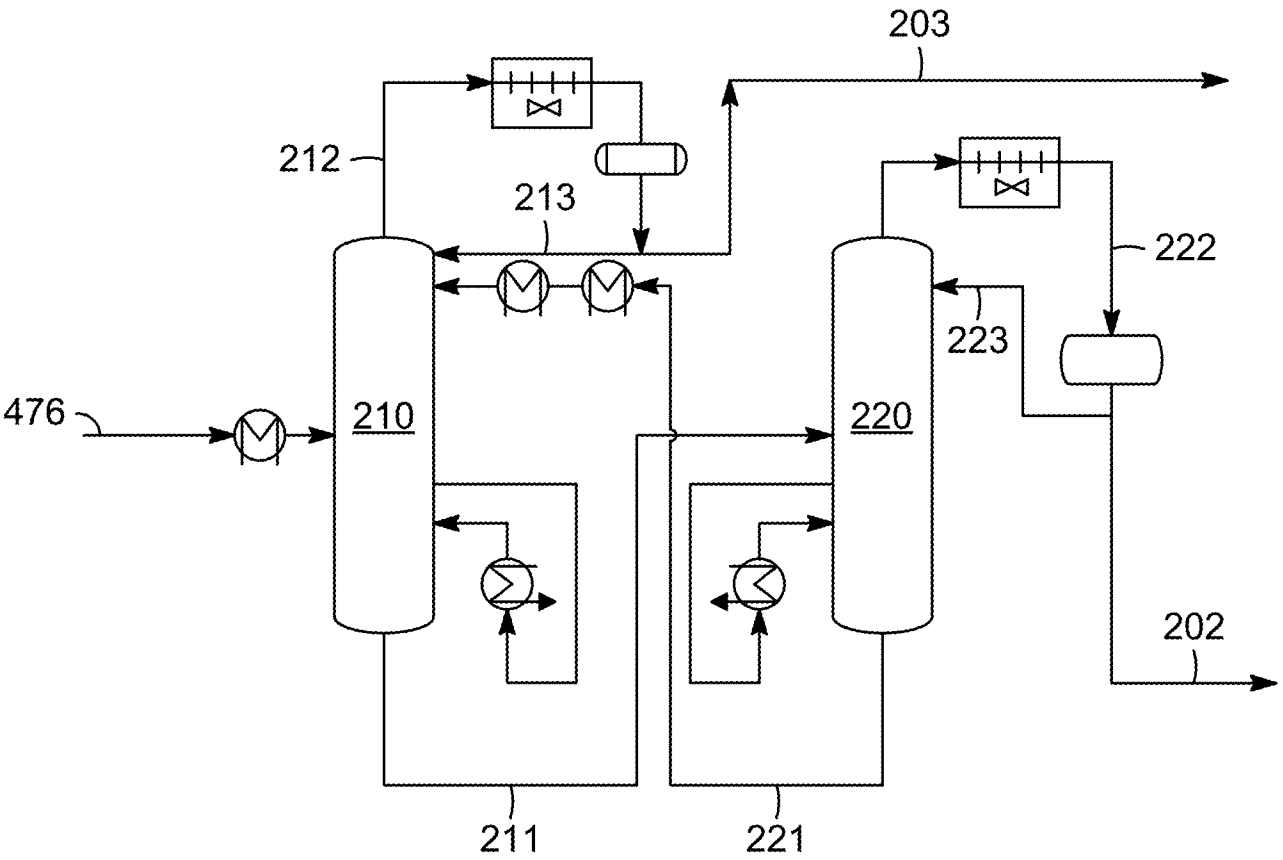
FIG. 2 is a process flow scheme for a separation unit used in the process of FIG. 1.
Figure 3:
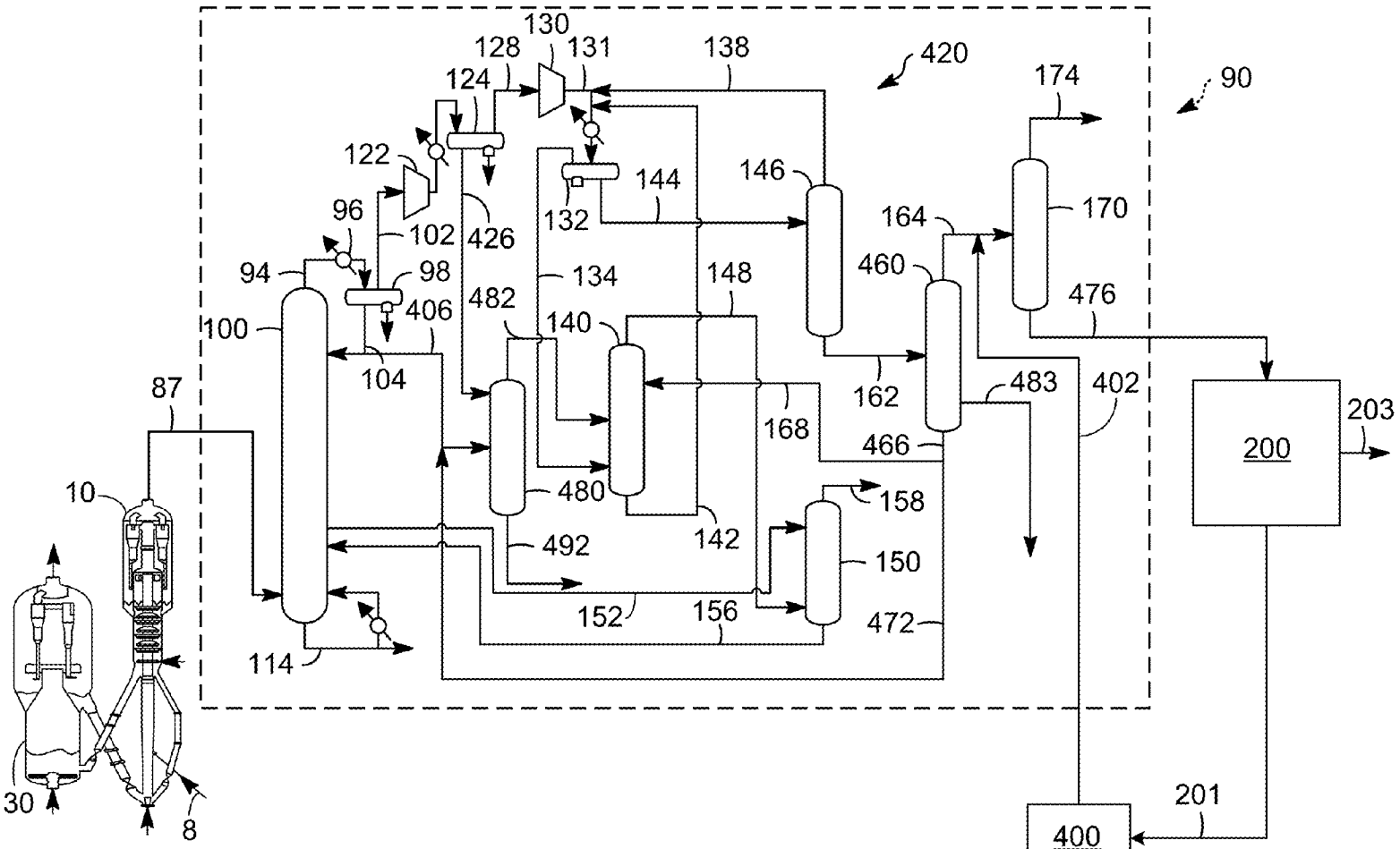
FIG. 3 is a process flow scheme for another embodiment of a process of the present invention.

A general understanding of the process and apparatus of this invention can be obtained by reference to FIGS. 1-3. FIGS. 1-3 have been simplified by the deletion of a large number of apparatuses customarily employed in a process of this nature, such as vessel internals, temperature and pressure controls systems, flow control valves, recycle pumps, etc. which are not specifically required to illustrate the performance of the invention. Furthermore, the illustration of the process of this invention in the embodiment of a specific drawing is not intended to limit the invention to specific embodiments set out herein.

Commercially there is a demand for FCC technology capable of producing high propylene yields from conventional feedstocks. We have found that propylene yield can be increased to a great extent economically by directing the $C_4$ and/or $C_5$ materials recovered from the fractionation zone to a separation unit. By selectively recovering the $C_4$ and/or $C_5$ olefins from the $C_4$ and/or $C_5$ paraffins and then passing the olefins to a second catalytic reactor, it is possible to increase the propylene yield but with surprisingly significantly less capital and utility costs over that provided by an equivalent FCC process without a $C_4$ materials separation unit.

One embodiment of the present invention is an apparatus and process that may be described with reference to four components shown in FIG. 1: a first catalytic reactor 10, a fractionation section 90, a separation unit 200, and a second catalytic reactor 300. Many configurations of the present invention are possible, but specific embodiments are presented herein by way of example. All other possible embodiments for carrying out the present invention are considered within the scope of the present invention.

The first catalytic reactor 10 may be an FCC reactor. A conventional FCC feedstock and higher boiling hydrocarbon feedstock are a suitable first feed 8 to the first FCC reactor. The most common of such conventional feedstocks is a "vacuum gas oil" (VGO), which is typically a hydrocarbon material having a boiling range of from 343° to 552° C. (650° to 1025° F.) prepared by vacuum fractionation of atmospheric residue. Such a fraction is generally low in coke precursors and heavy metal contamination which can serve to contaminate catalyst. Heavy hydrocarbon feedstocks to which this invention may be applied include heavy bottoms from crude oil, heavy bitumen crude oil, shale oil, tar sand extract, deasphalted residue, products from coal liquefaction, atmospheric and vacuum reduced crudes. Heavy feedstocks for this invention also include mixtures of the above hydrocarbons and the foregoing list is not comprehensive. Moreover, additional amounts of feed may also be introduced downstream of the initial feed point.

The first catalytic reactor 10, which may be an FCC reactor, can operate at any suitable temperature, and typically operates at a temperature of about 150° to about 580° C., preferably about 520° to about 580° C. at the reactor outlet. In one exemplary embodiment, a higher temperature may be desired, such as no less than about 565° C. at the outlet and a pressure of from about 69 to about 517 kPa (gauge) (10 to 75 psig) but typically less than about 275 kPa (gauge) (40 psig). The catalyst-to-oil ratio, based on the weight of catalyst and feed hydrocarbons entering the bottom of the reactor, may range up to 30:1 but is typically between about 4:1 and about 25:1. Hydrogen is not normally added to the reactor. Steam may be passed into the first reactor 10 equivalent to about 2 to 35 wt % of feed. Typically, however, the steam rate may be between about 2 and about 7 wt % for maximum gasoline production and about 10 to about 30 wt % for maximum light olefin production. The average residence time of catalyst in the reactor may be less than about 5 seconds.

The catalyst in the first catalytic reactor 10 can be a single catalyst or a mixture of different catalysts. Usually, the catalyst includes two components or catalysts, namely a first component or catalyst, and a second component or catalyst. Such a catalyst mixture is disclosed in, e.g., U.S. Pat. No. 7,312,370. Generally, the first component may include any of the well-known catalysts that are used in the art of FCC, such as an active amorphous clay-type catalyst and/or a high activity, crystalline molecular sieve. Zeolites may be used as molecular sieves in FCC processes. Preferably, the first component includes a large pore zeolite, such as a Y-type zeolite, an active alumina material, a binder material, including either silica or alumina, and an inert filler such as kaolin.

Typically, the zeolitic molecular sieves appropriate for the first component have a large average pore size. Usually, molecular sieves with a large pore size have pores with openings of greater than about 0.7 nanometers in effective diameter defined by greater than about 10, and typically about 12, member rings. Pore Size Indices of large pores can be above about 31. Suitable large pore zeolite components may include synthetic zeolites such as X and Y zeolites, mordenite and faujasite. A portion of the first component, such as the zeolite, can have any suitable amount of a rare earth metal or rare earth metal oxide.

The second component may include a medium or smaller pore zeolite catalyst, such as a MFI zeolite, as exemplified by at least one of ZSM-5, ZSM-11, ZSM-12, ZSM-23, ZSM-35, ZSM-38, ZSM-48, and other similar materials. Other suitable medium or smaller pore zeolites include ferrierite, and erionite. Preferably, the second component has the medium or smaller pore zeolite dispersed on a matrix including a binder material such as silica or alumina and an inert filler material such as kaolin. The second component may also include some other active material such as Beta zeolite. These compositions may have a crystalline zeolite content of about 10 wt % to about 50 wt % or more, and a matrix material content of about 50 wt % to about 90 wt %. Components containing about 40 wt % crystalline zeolite material are preferred, and those with greater crystalline zeolite content may be used. Generally, medium and smaller pore zeolites are characterized by having an effective pore opening diameter of less than or equal to about 0.7 nanometers, rings of about 10 or fewer members, and a Pore Size Index of less than about 31. Preferably, the second catalyst component is an MFI zeolite having a silicon-to-aluminum ratio greater than about 15, preferably greater than about 75. In one exemplary embodiment, the silicon-to-aluminum ratio can be about 15:1 to about 35:1.

The total catalyst mixture in the first reactor 10 may contain about 1 to about 25 wt % of the second component, including a medium to small pore crystalline zeolite with greater than or equal to about 7 wt % of the second component being preferred. When the second component contains about 40 wt % crystalline zeolite with the balance being a binder material, an inert filler, such as kaolin, and optionally an active alumina component, the catalyst mixture may contain about 0.4 to about 10 wt % of the medium to small pore crystalline zeolite with a preferred content of at least about 2.8 wt %. The first component may comprise the balance of the catalyst composition. In some preferred embodiments, the relative proportions of the first and second components in the mixture may not substantially vary throughout the first reactor 10. The high concentration of the medium or smaller pore zeolite as the second component of the catalyst mixture can improve selectivity to light olefins. In one exemplary embodiment, the second component can be a ZSM-5 zeolite and the catalyst mixture can include about 0.4 to about 10 wt % ZSM-5 zeolite excluding any other components, such as binder and/or filler. Coke is deposited on the catalyst when it contacts the feed in the reactor 10. Coked catalyst is regenerated by combustion in the regenerator 30 and recycled back to the reactor 10.

First cracked products in the line 87 from the first catalytic reactor 10, relatively free of catalyst particles, exit the first catalytic reactor 10. The first cracked products stream in the line 87 may be subjected to additional treatment to remove fine catalyst particles or to further prepare the stream prior to fractionation. The first cracked products stream in the line 87 can be combined with the second cracked products stream in a line 301 to produce a products stream in line 88. The line 88 transfers the cracked products streams to the fractionation section 90 that in an embodiment may include a main fractionation column 100 and a gas recovery section 420.

The main column 100 is a fractionation column with trays and/or packing positioned along its height for vapor and liquid to contact and reach equilibrium proportions at tray conditions and a series of pump-arounds to cool the contents of the main column. The main fractionation column is in downstream communication with the first reactor 10 and second reactor 300 and can be operated with an top pressure of about 35 to about 172 kPa (gauge) (5 to 25 psig) and a bottom temperature of about 343° to about 399° C. (650° to 750° F.). In the product recovery section 90, the gaseous FCC product in line 88 is directed to a lower section of an FCC main fractionation column 100. A variety of products are withdrawn from the main column 100. In this case, the main column 100 recovers an overhead stream of light products comprising unstabilized naphtha and lighter gases in an overhead line 94. The overhead stream in overhead line 94 is condensed in a condenser and perhaps cooled in a cooler both represented by 96 before it enters a receiver 98 in downstream communication with the first reactor 10. A line 102 withdraws a light off-gas stream of liquefied petroleum gas (LPG) and dry gas from the receiver 98. An aqueous stream is removed from a boot in the receiver 98. A bottoms liquid stream of light unstabilized naphtha leaves the receiver 98 via a line 104. A first portion of the bottoms liquid stream is directed back to an upper portion of the main column and a second portion in line 406 may be directed to the gas recovery section 420. Both lines 102 and 406 may be fed to the gas recovery section 420. Several other fractions may be separated and taken from the main column including an optional heavy slurry oil from the bottom in line 114.

In the embodiment shown in FIG. 1, the naphtha splitter column 480 may be located upstream of a primary absorber column 140 to improve the efficiency of the gas recovery unit. This embodiment has the advantage of decreasing the molecular weight of the primary absorber lean oil and also makes it possible to recover and heat the second hydrocarbon feed more efficiently. With the naphtha splitter column 480 positioned upstream of the primary absorber column 140, the second hydrocarbon feed can be recovered as a vapor draw from the debutanizer column bottom or reboiler since the heavy naphtha is recovered in the upstream naphtha splitter.

The gas recovery section 420 is shown to be an absorption based system, but any vapor recovery system may be used including a cold box system. To obtain sufficient separation of light gas components, the gaseous stream in line 102 is compressed in a compressor 122, also known as a wet gas compressor, which is in downstream communication with the main fractionation column overhead receiver 98. Any number of compressor stages may be used, but typically dual stage compression is utilized. In dual stage compression, compressed fluid from compressor 122 is cooled and enters an interstage compressor receiver 124 in downstream communication with the compressor 122. Liquid in line 426 from a bottom of the compressor receiver 124 and the unstabilized naphtha in line 406 from the main fractionation column overhead receiver 98 flow into the naphtha splitter column 480 in downstream communication with the compressor receiver 124. In an embodiment, these streams may join and flow into the naphtha splitter column 480 together. In the embodiment shown in FIG. 1, line 426 flows into the naphtha splitter column 480 at a higher elevation than line 406. The naphtha splitter column 480 is also in downstream communication with a bottom of the main fractionation column overhead receiver 98 and the first reactor 10. In an embodiment, the naphtha splitter column 480 is in direct downstream communication with the bottom of the overhead receiver 98 of the main fractionation column 100 and/or a bottom of the interstage compressor receiver 124. Gas in line 128 from a top of the compressor receiver 124 enters a second compressor 130, also known as a wet gas compressor, in downstream communication with the compressor receiver 124. Compressed effluent from the second compressor 130 in line 131 is joined by streams in lines 138 and 142, and gaseous components are partially condensed and all flow to a second compressor receiver 132 in downstream communication with the second compressor 130. Compressed gas from a top of the second compressor receiver 132 travels in line 134 to enter a primary absorber column 140 at a lower point than an entry point for the naphtha splitter overhead stream in line 482. The primary absorber column 140 is in downstream communication with an overhead of the second compressor receiver 132. A liquid stream from a bottom of the second compressor receiver 132 travels in line 144 to a stripper column 146.

The naphtha splitter column 480 may split naphtha into a heavy naphtha bottoms, typically $C_7^+$, in line 492 which may be recovered in line 184. An overhead stream from the naphtha splitter column 480 may carry light naphtha in line 482, typically a $C_7^-$ material, to the primary absorber column 140. The compressed gas stream in line 134 may enter the primary absorber column 140 which is in downstream communication with the naphtha splitter column 480. In this location the naphtha splitter column 480 may be operated at a top pressure to keep the overhead in liquid phase, such as about 344 to about 3034 kPa (gauge) (50 to 150 psig) and a temperature of about 135° to about 191° C. (275° to 375° F.).

The gaseous hydrocarbon stream in lines 134 fed to the primary absorber column 140 is contacted with naphtha from the naphtha splitter overhead in line 482 to effect a separation between $C_3^+$ and $C_2^-$ hydrocarbons by absorption of the heavier hydrocarbons into the naphtha stream upon counter-current contact. A debutanized naphtha stream in line 168 from the bottom of a debutanizer column 460 is delivered to the primary absorber column 140 at a higher elevation than the naphtha splitter overhead stream in line 482 to effect further separation of $C_3^+$ from $C_2^-$ hydrocarbons. The primary absorber column 140 utilizes no condenser or reboiler but may have one or more pump-arounds to cool the materials in the column. A liquid $C_3^+$ stream in line 142 from the bottoms of the primary absorber column is returned to line 131 upstream of condenser to be cooled and returned to the second compressor receiver 132. An off-gas stream in line 148 from a top of the primary absorber 140 is directed to a lower end of a secondary or sponge absorber 150. A circulating stream of light cycle oil (LCO) in line 152 absorbs most of the remaining $C_5^+$ material and some $C_3$-$C_4$ material in the off-gas stream in line 148 by counter-current contact. LCO from a bottom of the secondary absorber in line 156 richer in $C_3^+$ material than the circulating stream in line 152 is returned in line 156 to the main column 100. The overhead of the secondary absorber column 150 comprising dry gas of predominantly $C_2^-$ hydrocarbons with hydrogen sulfide, amines and hydrogen is removed in line 158 and may be subjected to further separation to recover ethylene and hydrogen.

Liquid from a bottom of the second compressor receiver 132 in line 144 is sent to the stripper column 146. Most of the $C_2^-$ material is stripped from the $C_3$-$C_7$ material and removed in an overhead of the stripper column 146 and returned to line 131 via overhead line 138 without first undergoing condensation. The overhead gas in line 138 from the stripper column comprising $C_2^-$ material, LPG and some light naphtha is returned to line 131 without first undergoing condensation. Therefore, only light naphtha is circulated in the gas recovery section 420. The condenser on line 131 will partially condense the overhead stream from line 138 with the gas compressor discharge in line 131 and with the bottoms stream 142 from the primary absorber column 140 will undergo vapor-liquid separation in second compressor receiver 132. The stripper column 146 is in downstream communication with the first reactor 10, a bottom of the second compressor receiver 132, a bottom of the primary absorber 140 and an overhead of the naphtha splitter 480 via the primary absorber column. The bottoms product of the stripper column 146 in line 162 is rich in light naphtha.

FIG. 1 shows that the liquid bottoms stream from the stripper column 146 may be sent to a first debutanizer column 460 via line 162. The debutanizer column 460 is in downstream communication with the first reactor 10, a bottom of the second compressor receiver 132, and the bottom of the primary absorber 140 and an overhead of the naphtha splitter 480. The debutanizer column 460 may fractionate a portion of first cracked products from the first catalytic reactor 10 to provide a $C_4^-$ overhead stream and $C_5^+$ bottoms stream. A portion of the debutanizer bottoms in line 466 may be split between line 168 carrying debutanized naphtha to the primary absorber column 140 to assist in the absorption of $C_3^+$ materials and line 472, which may recycle debutanized naphtha to the naphtha splitter 480 optionally in combination with line 406. The overhead stream in line 164 from the debutanizer comprises $C_3$-$C_4$ olefinic product which can be sent to an LPG splitter column 170 which is in downstream communication with an overhead of the debutanizer column 460.

In the LPG splitter column 170, $C_3$ materials may be forwarded from the overhead in a line 174 to a $C_3$ splitter to recover propylene product. $C_4$ materials from the bottom in line 476 may be recovered for blending in a gasoline pool as product or further processed. The line 476 is in communication with the separation unit 200, wherein $C_4$ materials comprising olefins and paraffins are separated with $C_4$ olefins recovered from the separation unit in the line 202 and $C_4$ paraffins recovered in the line 203.

In an embodiment, $C_4$ material in line 202 may be delivered as a second hydrocarbon feed to a second catalytic reactor 300 which is in downstream communication with an overhead of the main fractionation column 100, a bottom of the primary absorber 140, the separation unit 200 and a bottom of the LPG splitter 170. The second catalytic reactor 300 is in downstream communication with the separation unit 200. In an embodiment, a light naphtha stream may be withdrawn from a side of the debutanizer 460 as a side cut in line 483 and recovered. The second catalytic reactor 300 may be a fluidized bed reactor or an ebullating bed reactor. The second catalytic reactor 300 may be a second FCC reactor. Although the second reactor 300 is depicted as a second FCC reactor, it should be understood that any suitable catalytic reactor can be utilized, such as a fixed bed or a fluidized bed reactor. The second catalytic reactor may also be an olefin cracking reactor or an oligomerization reactor. For purposes of this discussion, the second catalytic reactor will be treated as a second FCC reactor. The second hydrocarbon feed may be fed to the second FCC reactor 300 in recycle feed line 202. The second hydrocarbon feed is preferably a portion of the first cracked products produced in the first reactor 10, fractionated in the main column 100 of the product recovery section 90 and provided to the second reactor 300. In an embodiment, the second reactor is in downstream communication with the product fractionation section 90, the separation unit 200 and/or the first reactor 10 which is in upstream communication with the product fractionation section 90.

The second hydrocarbon feed is contacted with catalyst in the second catalytic reactor 300 to produce upgraded products. The catalyst may be fluidized by inert gas. Generally, the second reactor 300 may operate under conditions to convert the light naphtha feed to smaller hydrocarbon products. $C_4$ olefins crack into one or more light olefins, such as ethylene and/or propylene. The mixture of gaseous, upgraded product hydrocarbons in the line 301 is combined with the hydrocarbon product in the line 87 for delivery to the main column via the line 88. In some embodiments, the second catalytic reactor 300 can contain a mixture of the first and second catalyst components as described above for the first reactor. In one preferred embodiment, the second reactor 300 can contain less than about 20 wt %, preferably less than about 5 wt % of the first component and at least 20 wt % of the second component. In another preferred embodiment, the second reactor 300 can contain only the second component, preferably a ZSM-5 zeolite, as the catalyst. Coked catalyst from the second reactor 300 may also be regenerated in the regenerator 30 and recycled back to the second reactor 300.

The second reactor 300 can operate in any suitable condition, such as a temperature of about 425° to about 705° C., preferably a temperature of about 550° to about 600° C., and a pressure of about 40 to about 700 kPa (gauge), preferably a pressure of about 40 to about 400 kPa (gauge), and optimally a pressure of about 200 to about 250 kPa (gauge). Typically, the residence time of the second reactor 300 can be less than about 5 seconds and preferably is between about 2 and about 3 seconds. Exemplary risers and operating conditions are disclosed in, e.g., U.S. Pat. No. 7,247,233 and U.S. Pat. No. 6,538,169.

In an aspect, the $C_4$ paraffin stream in line 203 can be fed to the first catalytic reactor 10. Line 203 may be mixed with the feed in line 8 to become the main feed for reactor 10. The $C_4$ paraffin stream may be fed to the first catalytic reactor 10 separate from the feed in line 8 at another location. Propylene production of the first reactor 10 is increased as the $C_4$ olefin material promotes selective cracking to $C_3$ olefins. A portion of the $C_4$ paraffin stream can be taken as product in line 204.

FIG. 2 shows the components of the separation unit 200 in detail. The separation unit 200 comprises two main vessels being an extraction vessel 210 and a distillation vessel 220. Paraffins and olefins enter the extraction vessel 210 through the line 476 wherein the hydrocarbon materials are contacted with an extraction material. The extraction vessel 210 may be operated at a bottom temperature of 90° C. to 140° C., with a top temperature of 30° C. to 90° C., and an overhead pressure of about 275 to about 690 kPa (gauge) or otherwise appropriate to maintain the aforementioned temperature profile. The extraction material enters the extraction vessel 210 through the line 221. The ratio of solvent to hydrocarbon should be between 2 and 20 by weight.

In one embodiment, when $C_4$ materials are contacted with the extraction material, an immiscible, biphasic mixture is formed, wherein the $C_4$ olefins selectively partition into an extract phase along with the extraction material while the $C_4$ paraffins remain in a raffinate phase. The $C_4$ materials may further comprise additional trace hydrocarbons which may also partition into the extract phase. In certain embodiments the extraction material is a chemical compound selected from the group consisting of dimethylformamide (DMF), acetonitrile (ACN), acetone, N-methyl-2-pyrrolidone (NMP), and N-formylmorpholine (NFM). Preferably, the chemical compound contains a morpholine group. More preferably the chemical compound is N-formylmorpholine (NFM). The raffinate phase composed primarily of the $C_4$ paraffins is recovered from the extraction vessel 210 through a line 212 and condensed. A portion of the line 212 can be returned to the extraction vessel 210 through a line 213 with the remainder of the raffinate phase sent on for further processing through a line 203.

The extract phase composed primarily of the $C_4$ olefins and the extraction material is recovered from the extraction vessel 210 through a line 211 which is in upstream communication with the distillation vessel 220. The distillation vessel 220 is operated in a manner so as to effect a separation of the extraction material from the $C_4$ olefins and additionally other trace hydrocarbons. Preferably, the separation is based on a difference in boiling points between the extraction material and the $C_4$ olefins. The distillation vessel 220 may contain trays, plates or an alternative packing material to effect the separation. The distillation vessel 220 may be operated with a bottoms temperature between about 160 and about 240° C. and preferably between about 180 and about 220° C. and a pressure between about 70 and about 350 kPa (gauge). In one example, a bottoms stream containing the higher boiling extraction material is recovered from the distillation vessel 220 through a bottoms line 221 which is in downstream communication with the extraction vessel 210. A distillate stream composed primarily of the $C_4$ olefins and optionally other trace hydrocarbons is recovered from the distillation vessel 220 through a line 222 and condensed. A portion of the line 222 can be returned to the distillation vessel 220 through a line 223 with the remainder of the distillate phase sent on for further processing as described in FIG. 1 by way of the line 202.

The following Table shows expected yields from the separation unit 200.

TABLE

Typical Yields
Separate Butanes from Butenes

| Components, wt % | Feed | Product Butanes | Product Butenes |
|---|---|---|---|
| i-Butane | 28.2 | 80.1 | — |
| n-Butane | 8.2 | 18.4 | 2.6 |
| i-Butene | 16.8 | 0.9 | 25.4 |
| n-Butene | 46.8 | 0.6 | 72.0 |
| Total | 100.0 | 100.0 | 100.0 |
| Butene Recovery, wt % | | | 99.2 |

One unique feature of the disclosed apparatus and process is that the configuration allows for the advantages of a traditional FCC unit configuration, but improves the overall configuration by allowing for the 4-carbon paraffins to be separated from the 4-carbon olefins. We have surprisingly found that combining a first reaction with a fractionation section, a separation unit for processing the $C_4$ materials and a second reactor not only results in a higher propylene yield, but also reduces the capital cost and utility cost when compared to process with a second product recovery section. In regard to the present invention, the overall process recovery section is simplified compared to a process with a separation unit as a common fractionation section can be used. This approach results in less dilution of the hydrocarbon feed to the second reactor 300 with paraffins hence providing a feed richer in olefins. With less dilution of the hydrocarbon feed with paraffins, the hydrocarbon feed rate is lower to the second catalytic reactor 300 and recirculation of $C_4^+$ material in the gas recovery section is limited to the primary absorber lean oil in line 142. The disclosed apparatus and process can provide propylene yields greater than 20% (e.g., about 25%).

The separation unit 200 may also be used to extract $C_5$ olefins from $C_5$ paraffins in a stream comprising $C_5$ hydrocarbons. Such a $C_5$ hydrocarbon stream may be obtained in FIG. 1 except that the debutanizer column 460 would be changed to a depentanizer column to provide a $C_3$-$C_5$ hydrocarbon stream in overhead line 164 and the LPG splitter column 170 would be changed to a debutanizer column to provide a $C_5$ hydrocarbon stream in bottoms line 476. It also envisioned that a mixed C4 and C5 hydrocarbon stream could be provided in line 476 as well. Such a $C_4$ and $C_5$ hydrocarbon stream may be obtained in FIG. 1 except that the debutanizer column 460 would be changed to a depentanizer column to provide a $C_3$-$C_5$ hydrocarbon stream in overhead line 164 and the LPG splitter column 170 would be changed to a depropanizer column to provide a $C_4$ and $C_5$ hydrocarbon stream in bottoms line 476.

Turning now to FIG. 3, another embodiment of the present invention is an apparatus and process that may be described with reference to four components shown in FIG. 3: a first catalytic reactor 10, a fractionation section 90, a separation unit 200, and an olefin cracking reactor 400. The embodiment of FIG. 3 differs from the embodiment of FIG. 1 in that the second catalytic reactor 300 of FIG. 1 have been removed and replaced with the olefin cracking reactor 400 and a line 402. The olefin cracking reactor 400 is in fluid communication with the LPG splitter column 170 via line 402. The similar components in FIG. 3 that were described above for FIGS. 1 and 2 will not be described again for FIG. 3.

In the apparatus of FIG. 3, the process stream containing $C_4$ olefins and/or $C_5$ olefins from line 201 is introduced into the olefin cracking reactor 400, such as in the form of a fixed bed reactor, and the process stream contacts with an olefin cracking catalyst and at reaction conditions effective to convert $C_4$ olefins to form a cracked olefins effluent stream in line 402. The cracked olefins effluent stream comprises $C_2$ and $C_3$ olefins. Catalysts suitable for olefin cracking comprise a crystalline silicate of the MFI family which may be a zeolite, a silicalite or any other silicate in that family or the MEL family which may be a zeolite or any other silicate in that family. Examples of MFI silicates are ZSM-5 and Silicalite. An example of an MEL zeolite is ZSM-11. Other examples are Boralite D and Silicalite-2 as described by the International Zeolite Association, Atlas of Zeolite Structure Types. The preferred crystalline silicates have pores or channels defined by ten oxygen rings and a high silicon/aluminum atomic ratio typically of at least 120 attained by suitable dealumination methods.

The catalyst has structural and chemical properties and is employed under particular reaction conditions whereby the catalytic cracking of the $C_4$ olefins readily proceeds. Different reaction pathways can occur on the catalyst. Suitable olefin cracking process conditions include a temperature of around 400° to 600° C., preferably from 500° to 600° C., and a pressure of from 100 to 500 kPa.

As shown in FIG. 3, the cracked olefins effluent stream from the olefin cracking reactor 400 can be appropriately processed by being returned to the LPG splitter column 170 via line 402. The cracked olefins effluent stream may include ethylene and propylene. In the LPG splitter column 170, $C_2$ and $C_3$ materials may be forwarded from the overhead in a line 174 to an ethylene recovery unit to recover ethylene product and a propylene recovery unit to recover propylene product. The bottom stream in line 476 may be sent to the separation unit 200 for further processing as described above.

EXAMPLES

Figure 4:
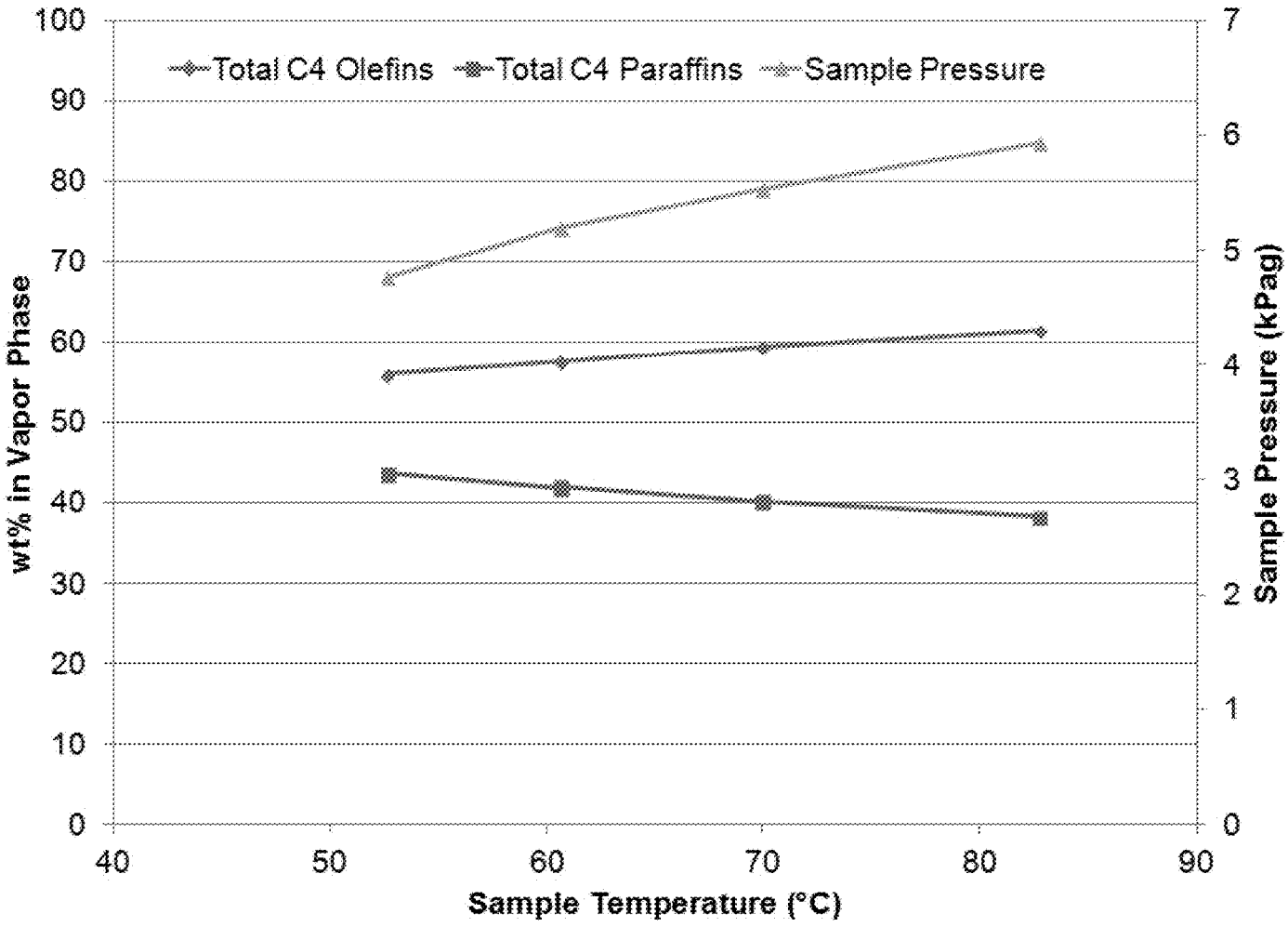
FIG. 4 is a plot of butene extraction versus temperature and pressure.

A feed comprising 67 wt-% butenes and 33 wt-% butanes was mixed with NMP solvent at a solvent to hydrocarbon ratio of 14:1 by weight at a range of 53 to 83° C. and a pressure of 4.7 to 5.9 kPa (gauge). Distillation of the extract overhead from the extraction vessel provided olefins in the vapor phase up to about 61 wt-% to about 38 wt-% paraffins indicating a reasonable separation as shown in FIG. 4 FIG. 4 indicates that the fraction of olefins in the distillation overhead may be increased at higher temperature and/or pressure.

Figure 5:
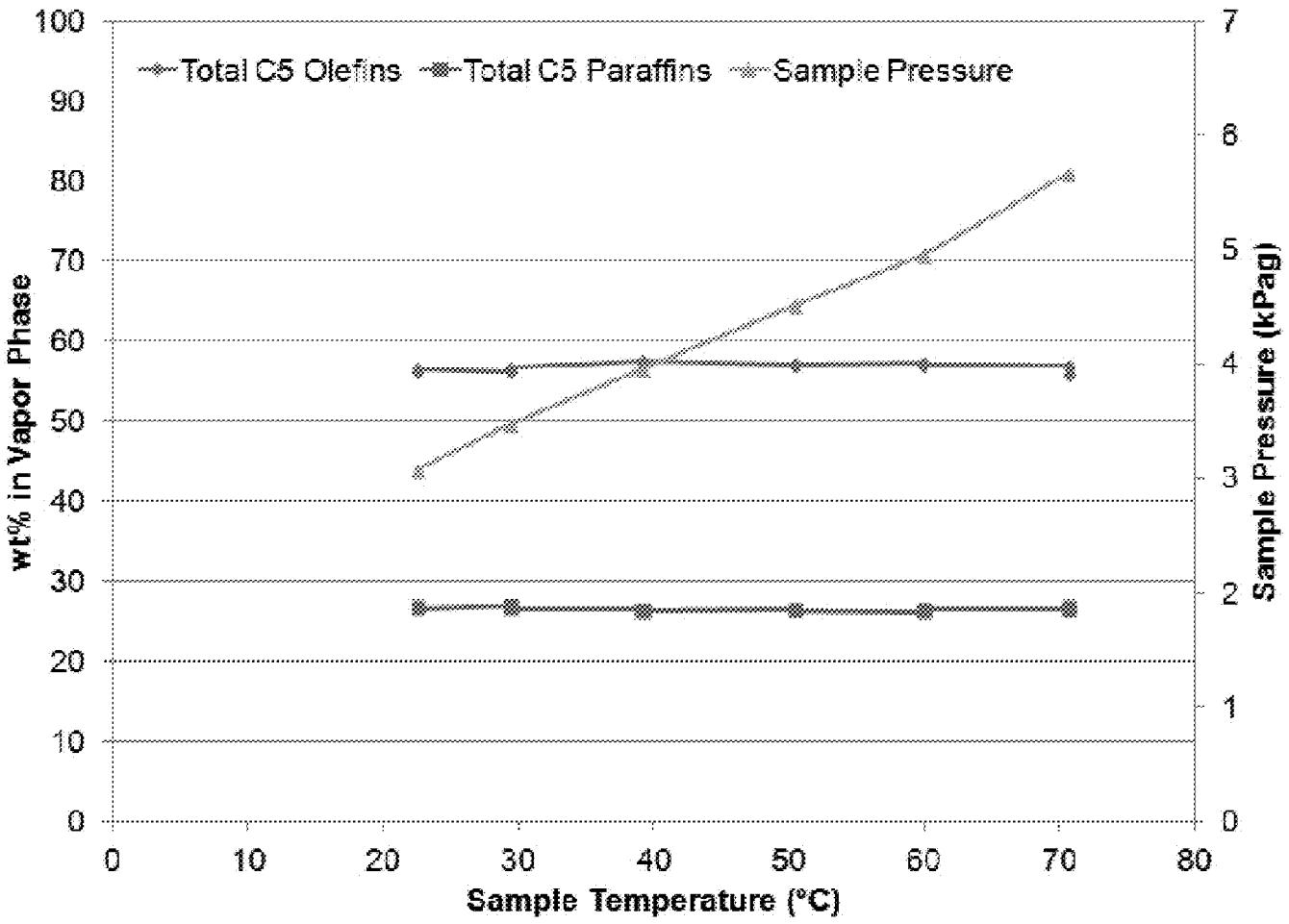
FIG. 5 is a plot of pentene extraction versus temperature and pressure.

A stream of pentenes may be extracted from pentanes. A feed comprising 73 wt-% pentenes and 26 wt-% pentanes was mixed with NMP solvent at a solvent to hydrocarbon ratio of 8:1 by weight at a range of 22 to 71° C. and a pressure of 3.1 to 5.7 kPa (gauge). Distillation of the extract overhead from the extraction vessel provided olefins in the vapor phase up to about 57 wt-% to about 26 wt-% paraffins indicating a reasonable separation as shown in FIG. 5

Specific Embodiments

While the following is described in conjunction with specific embodiments, it will be understood that this description is intended to illustrate and not limit the scope of the preceding description and the appended claims.

A first embodiment of the invention is a process for catalytic cracking, the process comprising (a) feeding a hydrocarbon feed stream to a first catalytic reactor; (b) passing an effluent of the first catalytic reactor to a fractionation zone to produce a first fractionation zone stream and a second fractionation zone stream, the first fractionation zone stream comprising $C_{(x-1)}^-$ hydrocarbons, and the second fractionation zone stream comprising $C_x$ hydrocarbons, wherein x is an integer; (c) passing the second fractionation zone stream to a separation unit to produce a first separation unit stream and a second separation unit stream, the first separation unit stream comprising $C_x$ paraffins, and the second separation unit stream comprising $C_x$ olefins; and (d) feeding the second separation unit stream to a second catalytic reactor. An embodiment of the invention is one, any or all of prior embodiments in this paragraph up through the first embodiment in this paragraph further comprising (e) producing a third fractionation zone stream comprising $C_{(x+1)}^+$ hydrocarbons in the fractionation zone; and (f) feeding the third fractionation zone stream to the second catalytic reactor. An embodiment of the invention is one, any or all of prior embodiments in this paragraph up through the first embodiment in this paragraph wherein step (c) comprises (i) contacting the second fractionation zone stream with an extraction material to selectively extract $C_x$ olefins from the second fractionation zone stream; (ii) separating the residual $C_x$ paraffins in the second fractionation zone stream from the extraction material and $C_x$ olefins to produce the first separation unit stream; and (iii) recovering the $C_x$ olefins from the extraction material to produce the second separation unit stream. An embodiment of the invention is one, any or all of prior embodiments in this paragraph up through the first embodiment in this paragraph wherein steps (i) and (ii) further comprise a liquid-liquid extraction process. An embodiment of the invention is one, any or all of prior embodiments in this paragraph up through the first embodiment in this paragraph wherein the first separation unit stream is immiscible with the extraction material and $C_x$ olefins. An embodiment of the invention is one, any or all of prior embodiments in this paragraph up through the first embodiment in this paragraph wherein step (iii) further comprises recovering the $C_x$ olefins from the extraction material based on a difference in the boiling points of the $C_x$ olefins and the extraction material. An embodiment of the invention is one, any or all of prior embodiments in this paragraph up through the first embodiment in this paragraph wherein step (iii) further comprises recycling the extraction material for contacting with the second fractionation zone stream in step (i). An embodiment of the invention is one, any or all of prior embodiments in this paragraph up through the first embodiment in this paragraph wherein step (c) comprises feeding the second fractionation zone stream comprising paraffins, olefins and optionally traces of other hydrocarbons in gaseous or liquid form into a first separation vessel; feeding an extraction material in liquid form into the first separation vessel; separating the second fractionation zone stream into the first separation unit stream and a first bottom stream comprising the extraction material laden with the $C_x$ olefins and optionally traces of other hydrocarbons; feeding the first bottom stream to a second separation vessel; and separating the first bottom stream into the second separation unit stream and a second bottom stream comprising the extraction material. An embodiment of the invention is one, any or all of prior embodiments in this paragraph up through the first embodiment in this paragraph wherein the extraction material is a chemical compound comprising a morpholine group. An embodiment of the invention is one, any or all of prior embodiments in this paragraph up through the first embodiment in this paragraph further comprising recirculating the second bottom stream to the first separation vessel. An embodiment of the invention is one, any or all of prior embodiments in this paragraph up through the first embodiment in this paragraph further comprising passing an effluent of the second catalytic reactor to the fractionation zone, wherein the effluent of the second catalytic reactor comprises propylene. An embodiment of the invention is one, any or all of prior embodiments in this paragraph up through the first embodiment in this paragraph wherein the second catalytic reactor is a fixed bed reactor. An embodiment of the invention is one, any or all of prior embodiments in this paragraph up through the first embodiment in this paragraph wherein x equals 4. An embodiment of the invention is one, any or all of prior embodiments in this paragraph up through the first embodiment in this paragraph further comprising extracting $C_x$ paraffins from the second fractionation zone stream, thereby increasing the overall propylene yield of the process. An embodiment of the invention is one, any or all of prior embodiments in this paragraph up through the first embodiment in this paragraph further comprising reacting the $C_x$ olefins in the second catalytic reactor to produce $C_3$ olefins.

A second embodiment of the invention is a process for catalytic cracking, the process comprising (a) feeding a hydrocarbon feed stream to a first catalytic reactor; (b) passing an effluent of the first catalytic reactor to a fractionation zone to produce a first fractionation zone stream and a second fractionation zone stream, the first fractionation zone stream comprising $C_3$ hydrocarbons, and the second fractionation zone stream comprising $C_4$ hydrocarbons; (c) passing the second fractionation zone stream to a separation unit to produce a first separation unit stream and a second separation unit stream, the first separation unit stream comprising $C_4$ paraffins, and the second separation unit stream comprising $C_4$ olefins; (d) feeding the second separation unit stream to a second catalytic reactor; and (e) passing an effluent of the second catalytic reactor to the fractionation zone, wherein the effluent of the second catalytic reactor comprises propylene.

A third embodiment of the invention is a catalytic cracking system, comprising a first catalytic reactor configured to receive a hydrocarbon feed stream; a fractionation zone, the fractionation zone is in fluid communication with the first catalytic reactor, wherein the fractionation zone is configured to produce a first fractionation zone stream comprising $C_3$ or $C_4$ hydrocarbons and a second fractionation zone stream comprising $C_4$ and/or $C_5$ hydrocarbons; a separation unit, the separation unit is in fluid communication with fractionation zone, wherein separation unit is configured to produce a first separation unit stream comprising $C_4$ and/or $C_5$ paraffins and a second separation unit stream comprising $C_4$ and/or $C_5$ olefins; and a second catalytic reactor, the second catalytic reactor being in fluid communication with the separation unit for receiving the second separation unit stream. An embodiment of the invention is one, any or all of prior embodiments in this paragraph up through the third embodiment in this paragraph wherein the second catalytic reactor is in fluid communication with the fractionation zone for supplying $C_3$ hydrocarbons to the fractionation zone. An embodiment of the invention is one, any or all of prior embodiments in this paragraph up through the third embodiment in this paragraph wherein the second catalytic reactor is a fixed bed reactor, an ebullating bed reactor or a fluidized reactor. An embodiment of the invention is one, any or all of prior embodiments in this paragraph up through the third embodiment in this paragraph wherein the separation unit comprises a first separation vessel including an extraction material in liquid form for separating the second fractionation zone stream into the first separation unit stream and a first bottom stream comprising the extraction material laden with the $C_4$ and/or $C_5$ olefins; and a second separation vessel is in fluid communication with first separation vessel, the second separation vessel for receiving the first bottom stream and for separating the first bottom stream into the second separation unit stream and a second bottom stream comprising the extraction material.

Although the invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for catalytic cracking, the process comprising:

(a) feeding a hydrocarbon feed stream to a first catalytic cracking reactor;

(b) passing an effluent of the first catalytic cracking reactor to a fractionation zone to produce a first fractionation zone stream, a second fractionation zone stream, and a third fractionation zone stream, the first fractionation zone stream comprising $C_{(x-1)}^-$ hydrocarbons, the second fractionation zone stream comprising $C_x$ hydrocarbons, the third fractionation zone stream comprising $C_{(x+1)}^+$ hydrocarbons, and wherein x is an integer comprising 4 or 5;

(c) passing the second fractionation zone stream to a separation unit to produce a first separation unit stream and a second separation unit stream, the first separation unit stream comprising $C_x$ paraffins, and the second separation unit stream comprising $C_x$ olefins; and (d) feeding the second separation unit stream to a second catalytic cracking reactor.

2. The process of claim 1 further comprising:

(e) feeding the third fractionation zone stream to the second catalytic cracking reactor.

3. The process of claim 1 wherein step (c) comprises:

(i) contacting the second fractionation zone stream with an extraction material to selectively extract $C_x$ olefins from the second fractionation zone stream;

(ii) separating residual $C_x$ paraffins in the second fractionation zone stream from the extraction material and $C_x$ olefins to produce the first separation unit stream; and (iii) recovering the $C_x$ olefins from the extraction material to produce the second separation unit stream.

4. The process of claim 3 wherein steps (i) and (ii) further comprise a liquid-liquid extraction process.

5. The process of claim 3 wherein the first separation unit stream is immiscible with the extraction material and $C_x$ olefins.

6. The process of claim 3 wherein step (iii) further comprises recovering the $C_x$ olefins from the extraction material based on a difference in the boiling points of the $C_x$ olefins and the extraction material.

7. The process of claim 3 wherein step (iii) further comprises recycling the extraction material for contacting with the second fractionation zone stream in step (i).

8. The process of claim 1 wherein step (c) comprises:

feeding the second fractionation zone stream comprising paraffins, olefins and optionally traces of other hydrocarbons in gaseous or liquid form into a first separation vessel;

feeding an extraction material in liquid form into the first separation vessel;

separating the second fractionation zone stream into the first separation unit stream and a first bottom stream comprising the extraction material laden with the $C_x$ olefins and optionally traces of other hydrocarbons;

feeding the first bottom stream to a second separation vessel; and separating the first bottom stream into the second separation unit stream and a second bottom stream comprising the extraction material.

9. The process of claim 8 wherein the extraction material is a chemical compound comprising a morpholine group.

10. The process of claim 8 further comprising recirculating the second bottom stream to the first separation vessel.

11. The process of claim 1 further comprising passing an effluent of the second catalytic cracking reactor to the fractionation zone, wherein the effluent of the second catalytic cracking reactor comprises propylene.

12. The process of claim 1 wherein the second catalytic cracking reactor is a fixed bed reactor.

13. The process of claim 1 wherein x equals 4.

14. The process of claim 1 further comprising extracting $C_x$ paraffins from the second fractionation zone stream, thereby increasing the overall propylene yield of the process.

15. The process of claim 1 further comprising reacting the $C_x$ olefins in the second catalytic cracking reactor to produce $C_3$ olefins.

16. A process for catalytic cracking, the process comprising:

(a) feeding a hydrocarbon feed stream to a first catalytic cracking reactor;

(b) passing an effluent of the first catalytic cracking reactor to a fractionation zone to produce a first fractionation zone stream, a second fractionation zone stream, and a third fractionation zone stream, the first fractionation zone stream comprising $C_3$ hydrocarbons, the second fractionation zone stream comprising $C_4$ hydrocarbons, and the third fractionation zone stream comprising $C_5^+$ hydrocarbons;

(c) passing the second fractionation zone stream to a separation unit to produce a first separation unit stream and a second separation unit stream, the first separation unit stream comprising $C_4$ paraffins, and the second separation unit stream comprising $C_4$ olefins;

(d) feeding the second separation unit stream to a second catalytic cracking reactor; and (e) passing an effluent of the second catalytic cracking reactor to the fractionation zone, wherein the effluent of the second catalytic cracking reactor comprises propylene.

* * * * *